US012607012B1

(12) United States Patent
Warford

(10) Patent No.: US 12,607,012 B1
(45) Date of Patent: Apr. 21, 2026

(54) MODULAR WHEELCHAIR RAMP CANOPY

(71) Applicant: Lawrence Eugene Warford, Bonney Lake, WA (US)

(72) Inventor: Lawrence Eugene Warford, Bonney Lake, WA (US)

( * ) Notice: Subject to any disclaimer, the term of this patent is extended or adjusted under 35 U.S.C. 154(b) by 446 days.

(21) Appl. No.: 18/209,485

(22) Filed: Jun. 14, 2023

(51) Int. Cl.

| | |
|---|---|
| ***E04B 7/20*** | (2006.01) |
| ***E04D 13/064*** | (2006.01) |
| ***E04F 10/02*** | (2006.01) |
| *E04D 13/08* | (2006.01) |

(52) U.S. Cl.
CPC ..... *E04B 7/20* (2013.01); *E04D 13/0645* (2013.01); *E04F 10/02* (2013.01); *E04D 2013/0893* (2013.01)

(58) Field of Classification Search
CPC ..... E04B 7/20; E04D 2013/0893; E04D 2013/0806; E04F 10/02; E04F 10/08
See application file for complete search history.

(56) References Cited

U.S. PATENT DOCUMENTS

| | | | | | |
|---|---|---|---|---|---|
| 168,257 | A * | 9/1875 | Inghels | E04D 13/076 | 52/11 |
| 1,761,901 | A * | 6/1930 | Wickstrum | E04H 15/04 | 135/136 |
| 3,286,413 | A * | 11/1966 | Wells | E04F 10/08 | 52/16 |
| 3,389,513 | A * | 6/1968 | Ruggles | E04D 13/0481 | 52/630 |
| 3,524,289 | A * | 8/1970 | Yazejian | E04F 10/08 | 52/95 |
| 4,100,703 | A * | 7/1978 | Sickler | E04B 7/00 | 52/16 |

FOREIGN PATENT DOCUMENTS

| | | | | |
|---|---|---|---|---|
| DE | 202021000335 | U1 * | 3/2021 | E04B 7/163 |
| EP | 0989249 | A2 * | 3/2000 | E04B 1/0046 |
| EP | 3604704 | A1 * | 2/2020 | E04D 13/08 |
| EP | 4497889 | A1 * | 1/2025 | E04F 10/0607 |

* cited by examiner

*Primary Examiner* — Adriana Figueroa
(74) *Attorney, Agent, or Firm* — Joseph Z. Ellsworth

(57) ABSTRACT

A modular portable wheelchair ramp canopy configured to fit over and protect a wheelchair ramp from rain. The canopy has a gutter that channels rainwater into the canopy uprights and then down to the ground. The canopy also has an end section that slopes back to a gutter which collects rainwater and channels it into canopy uprights and then down to the ground.

20 Claims, 6 Drawing Sheets

MODULAR WHEELCHAIR RAMP CANOPY

BACKGROUND

Field of the Invention

This invention relates to canopies and more specifically to a canopy that fits with a lightweight and portable wheelchair ramp.

Prior Art

It is known to have wheelchair ramps. The American Disability Act (ADA) requires that wheelchair ramps be placed in all public entry ways, thus insuring entrance to all. Portable wheelchair ramps have long been used in various types of construction but may get slippery with continual rain and the resulting moss growth.

SUMMARY

It is an objective of some examples to address the problems in the prior art and provide a ramp suitable for wheelchair use that is protected from rainfall, and still comply with the ADA with a high safety factor. These objectives are achieved in a portable wheelchair ramp comprising a plurality of mechanically interconnected modular ramp sections. Ramp sections interconnect end to end with a male J-hook interlocking with a female J-hook on adjacent ramp ends. A bar below the hook extends into the keyway to further engage adjacent ramp ends, preventing relative vertical movement between the adjacent ramps.

Above the ramp is a ramp section canopy with a gutter, a canopy upright, and an adjustable leg. The gutter is configured to gather rainwater that runs off the ramp section canopy and channel the rainwater down the canopy upright and out through an adjustment channel in the adjustable leg and drain out onto a ground surface. The wheelchair ramp canopy may have an upright connector coupled to the gutter and a drain aperture that allows rainwater to exit the gutter into the upright connector.

A method of protecting a wheelchair ramp from rain may include the steps of providing a ramp section canopy and gathering rainwater from the ramp section canopy in a gutter. Then channeling the rainwater into a canopy upright and draining the rainwater out of an adjustment channel in an adjustable leg. The method may include coupling an upright connector to the gutter and providing a drain aperture in the upright connector to channel rainwater into the canopy upright.

DETAILED DESCRIPTION 2

A wheelchair ramp may become slippery from rain or from moss growth resulting from rain. A wheelchair ramp may also be long enough that protection from the rain during use is desired. A canopy that fits with a modular construction would ensure a good watertight fit of all canopy panels and simple construction.

Figure 1:
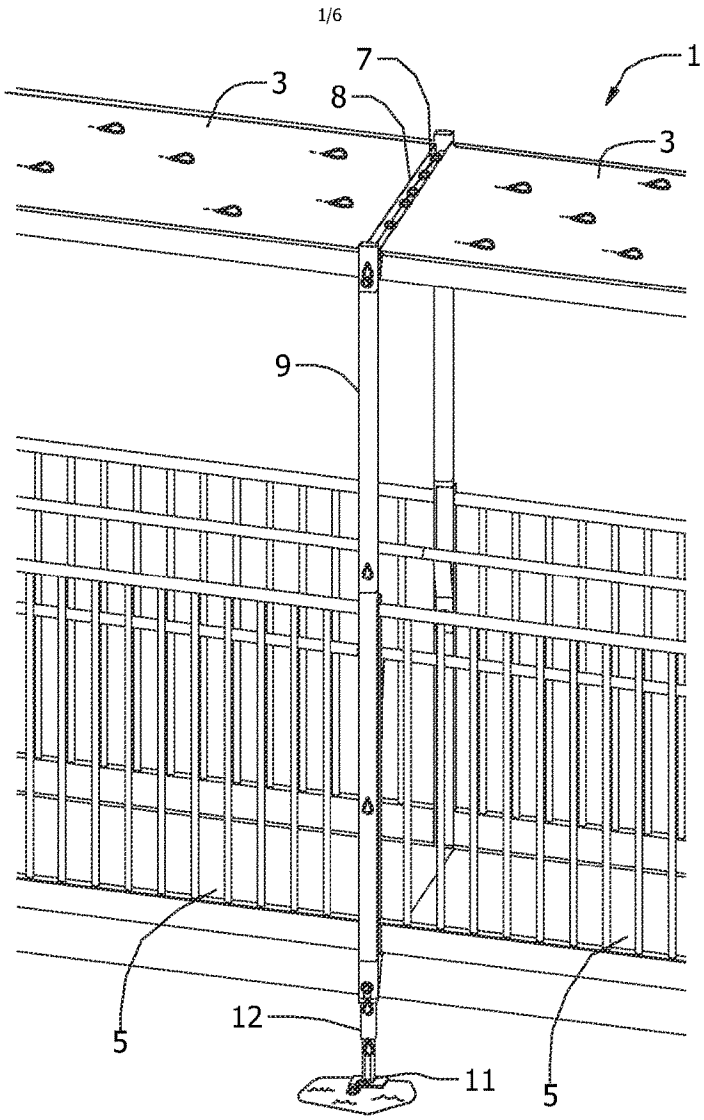
FIG. 1 is a perspective view of a ramp canopy and a ramp section showing rainwater running down the canopy and gathering in the gutter and flowing out of the canopy upright.

A wheelchair ramp canopy 1 of FIG. 1 has a ramp section canopy 3 or a plurality of ramp section canopies 3. The ramp section canopy 3 is sized to fit over a ramp section 5 having substantially the same width and length. The ramp section canopy 3 has a gutter 7 at the lower end 8. Rainwater will run down the ramp section canopy 3 and gather in the gutter 7 and then run down the canopy upright 9. The canopy upright 9 may terminate with an adjustable leg 11 and the rainwater will empty out of an adjustment channel 12 in the adjustable leg 11.

Figure 2:
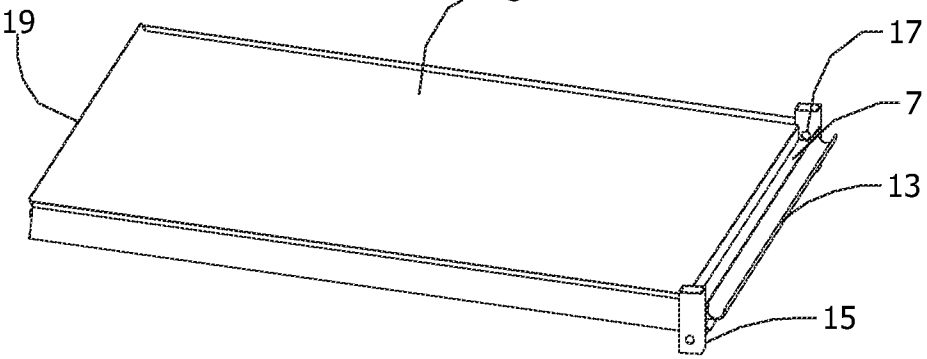
FIG. 2 is a perspective view of a ramp canopy section.

In FIG. 2 an example ramp section canopy 3 is shown in detail having a male J-hook connector 13 and an upright connector 15 on one end. The male J-hook connector 13 and the upright connector 15 may be on separate ends to fulfill certain design requirements. The upright connector 15 is coupled to the gutter 7 and a drain aperture 17 is made in the upright connector 15 to allow rainwater to exit the gutter 7 into the center of the upright connector 15. The male J-hook connector 13 is configured to fit into and lock inside a female J-hook connector 19 of an adjacent ramp section canopy 3.

Figure 3:
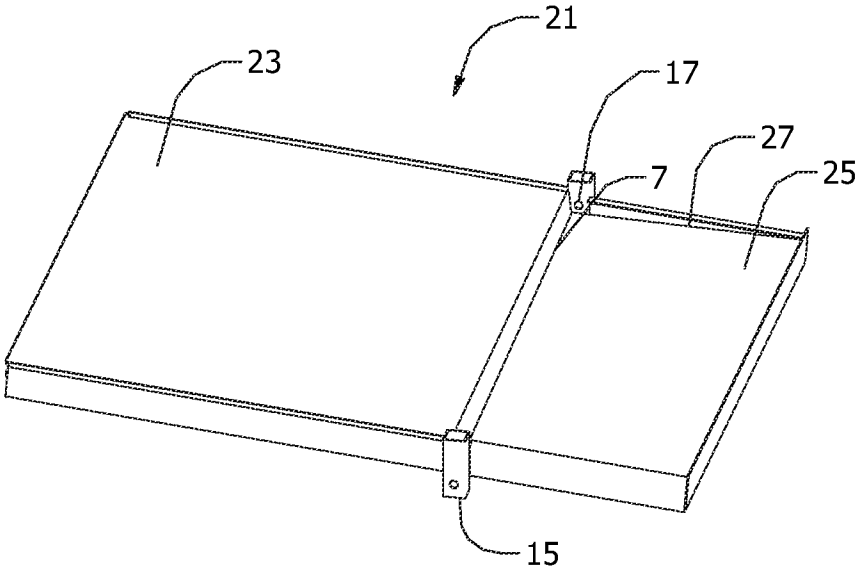
FIG. 3 is a perspective view of a ramp canopy end section.

In FIG. 3 an example ramp canopy end section 21 is shown. The ramp canopy end section 21 is the final piece of a canopy system that covers the final ramp section of a wheelchair ramp. The ramp canopy end section 21 may have two sections, a flat portion 23 and a back sloped portion 25. The ramp canopy end section flat portion 23 extends to an upright connector 15 and a gutter 7. The flat portion 23 may extend about ⅔ of the total length of the ramp canopy end section 21. The ramp canopy end section 21 configuration is largely determined by the dimensions and configuration of the ramp section below it. The ramp canopy end section back sloped portion 25 is configured to prevent rainwater from dripping of the end by providing a back slope angle 27 that causes rainwater to run back to the gutter 7 instead of off the end. The rainwater enters the gutter 7 and into the drain aperture 17 in the upright connector 15.

Figure 4:
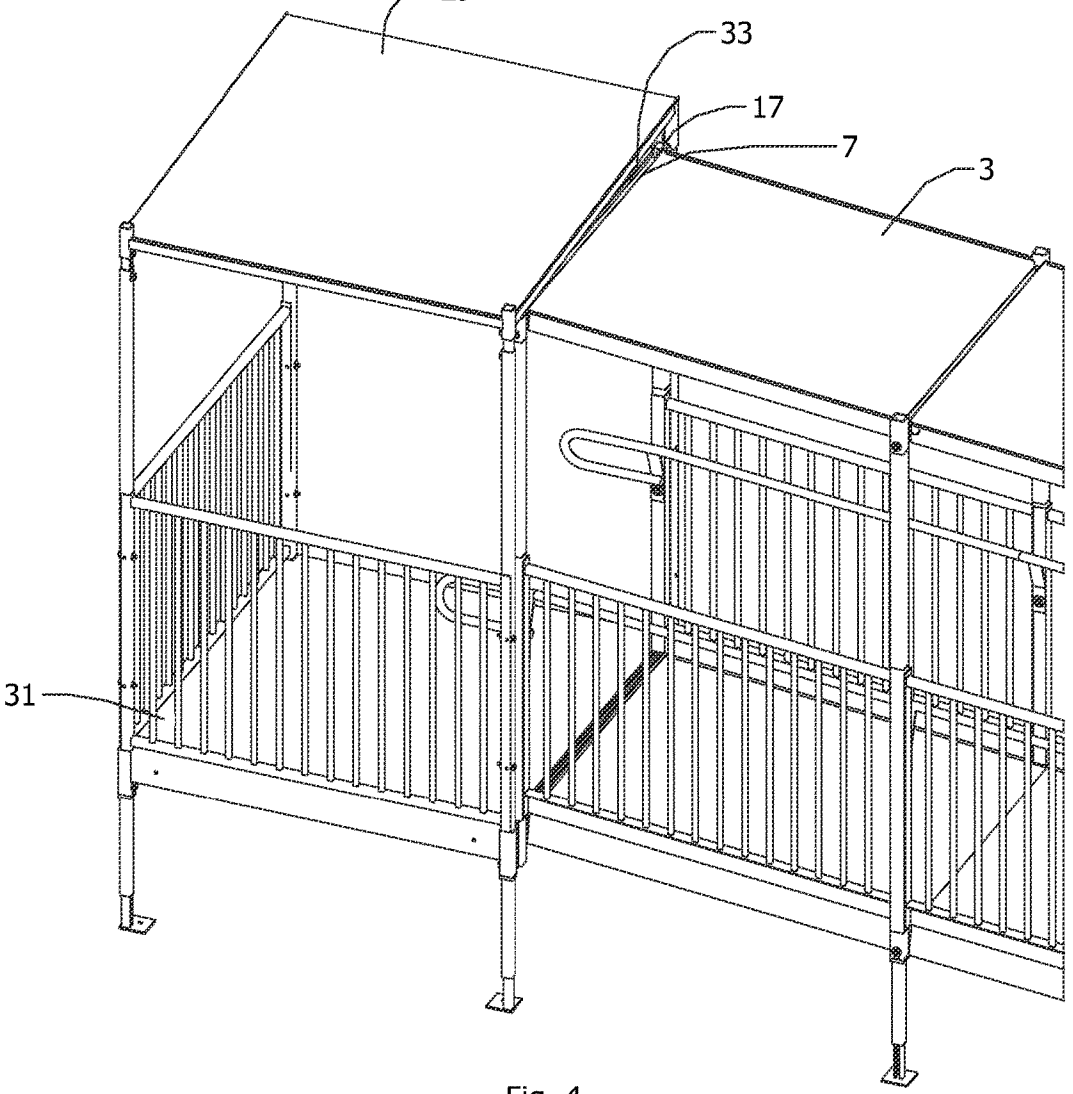
FIG. 4 is a perspective view of a ramp section canopy interfacing with a landing canopy.
Figure 5:
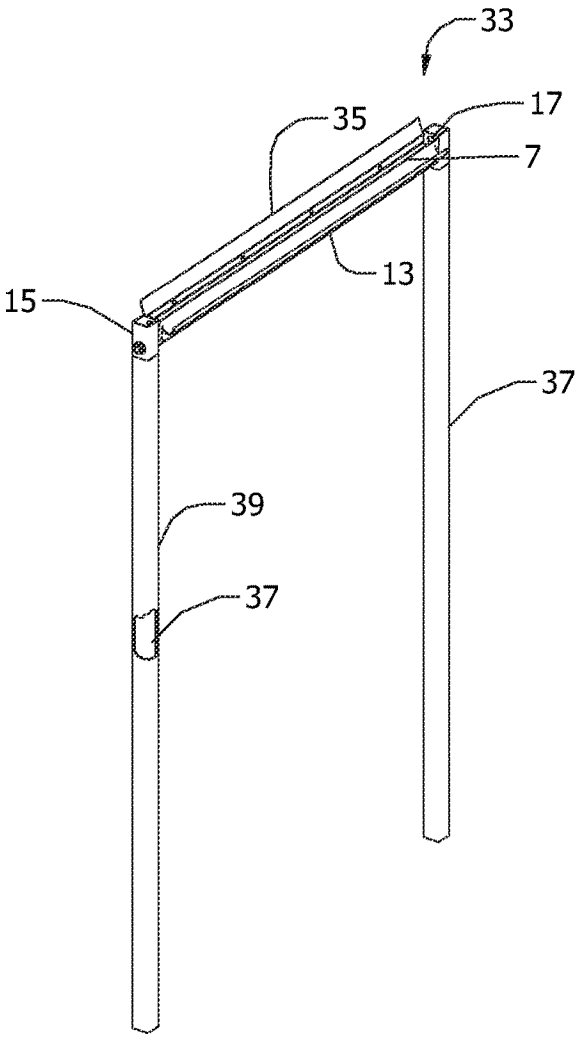
FIG. 5 is a perspective view of a canopy adaptor which may create a rain proof interface between a ramp section canopy and a landing canopy.

FIG. 4 depicts how the ramp section canopy 3 may be connected to a landing canopy 29. A landing 31 is flat, but the landing canopy 29 needs to move rainwater to a side and away from the landing 31 below. The landing canopy will have a slope in a plane skew to the ramp section canopy 3 that ramps down and away from it. This interface is difficult to seal against rain. A canopy adaptor 33 as seen in FIG. 5 attaches to the ramp section canopy by way of a male J-hook connector 13. A blade seal 35 is flexible and presses up against the landing canopy 29 to prevent rainwater from dripping between the landing canopy 29 and the canopy adaptor 33. Rainwater collects in the gutter 7 and runs into the drain aperture 17 and down the upright inner support post 37. The upright inner support post 37 is a smaller section for example 1.6-inch square tube. It is desirable to have larger sections and to a have all external dimensions be the same. Therefore, in some examples an upright cover post 39 that may be 2-inch square tube is put over the upright inner support post. This upright cover post 39 is typically the same dimension as the upright connector 15 so the entire canopy upright 9 looks the same dimension.

Figure 6:
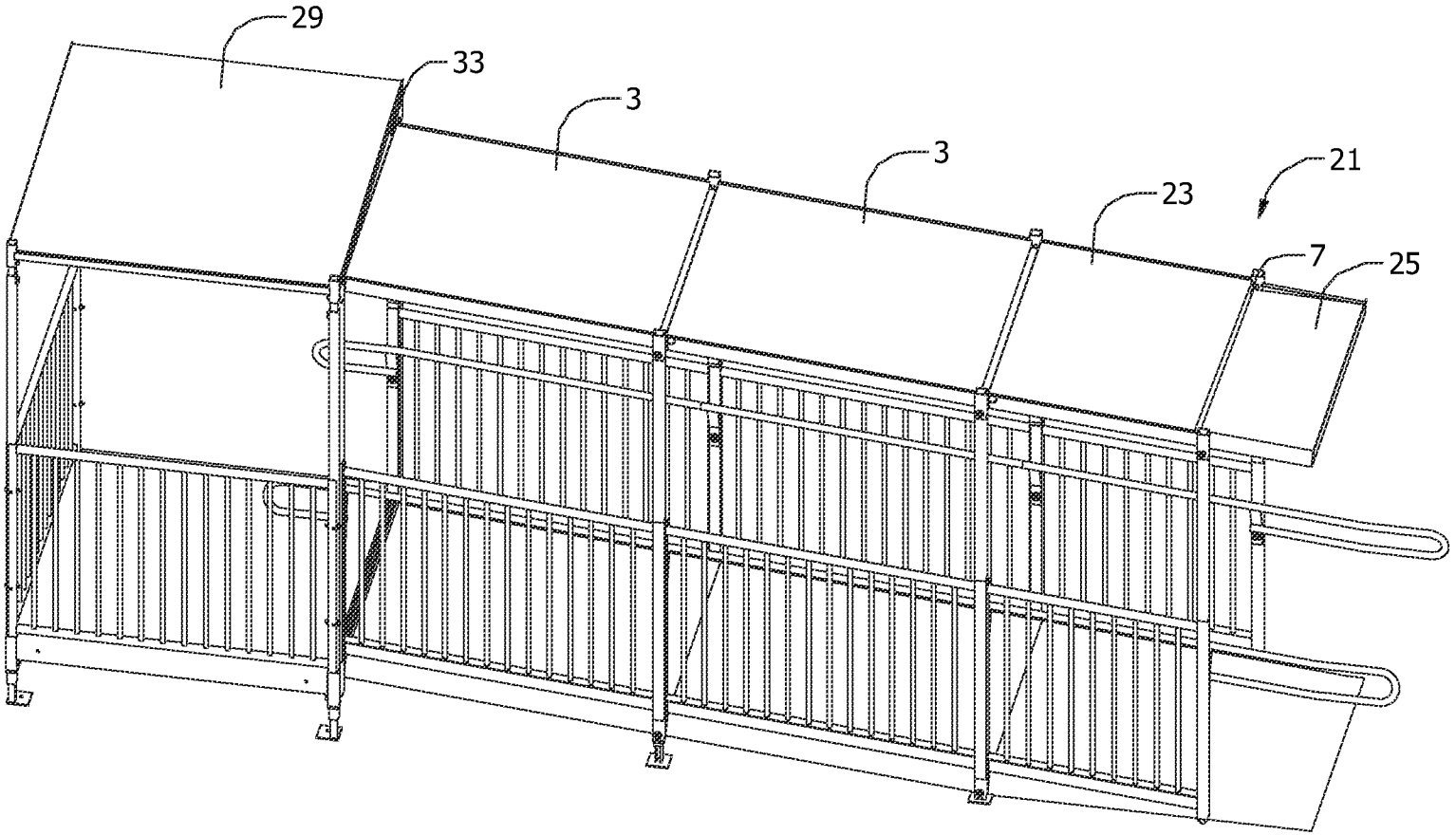
FIG. 6 is a perspective view of a plurality of ramp section canopies and a landing canopy, and a ramp canopy end section all positioned over a wheelchair ramp.
Figure 7:
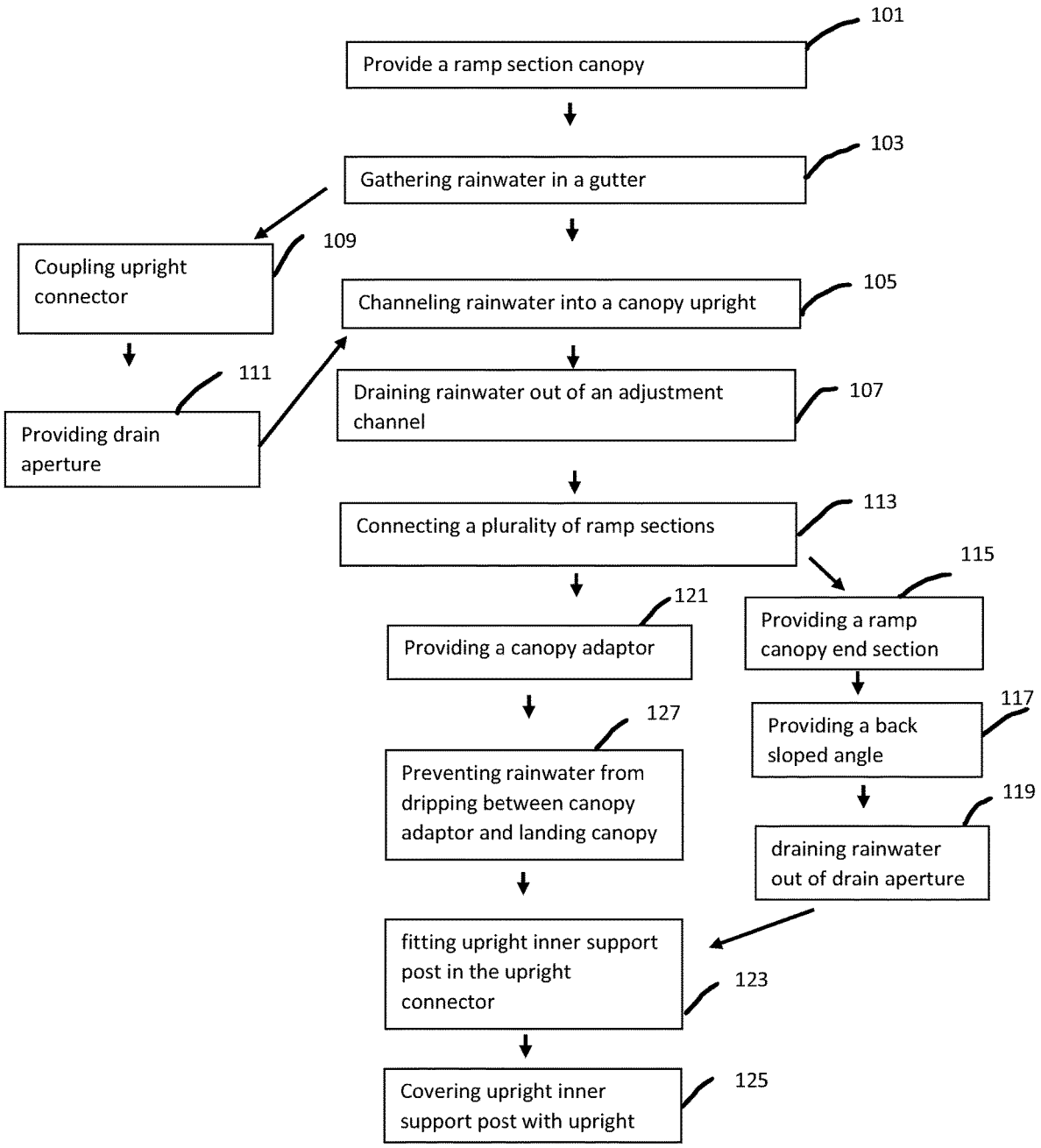
FIG. 7 is a flow diagram for a method of protecting a wheelchair ramp from rain.

FIG. 6 is an example wheelchair ramp canopy 1 from landing canopy 29 to a canopy adaptor 33 to a ramp section canopy 3 and terminating in a ramp canopy end section 21. The ramp canopy end section 21 having a back sloped portion 25 that overhangs the termination of the ramp below. The back sloped portion 25 slopes back to allow rainwater to enter the gutter 7 between the flat portion and the back sloped portion.

Further examples include a wheelchair ramp canopy 1 comprising a ramp section canopy 3, a gutter 7, a canopy upright 9, and an adjustable leg 11, wherein the gutter 7 is configured to gather rainwater and the canopy upright 9 is configured to channel rainwater down to an adjustment channel 12 in the adjustable leg 11 and drain out onto a ground surface. The wheelchair ramp canopy may further comprise, and an upright connector 15, wherein the upright connector 15 is coupled to the gutter 7, and a drain aperture 17 in the upright connector 15 is configured to allow rainwater to exit the gutter 7 into the upright connector 15. The upright connector 15 may have an inner support post 37 within it which the rainwater runs down. The inner support post 37 may have an upright cover post 39 covering it decoratively. The wheelchair ramp canopy 1 may further comprise a male J-hook connector 13 on one side and a female J-hook connector 19 on the opposite side and the male J-hook connector 13 is configured to fit into and lock inside a female J-hook connector 19 of an adjacent ramp section canopy 3. The wheelchair ramp canopy 1 may further comprise, a ramp canopy end section a flat portion 23, and a ramp canopy end section back sloped portion 25, wherein the flat portion 23 extends to an upright connector 15 and a gutter 7. The flat portion 23 and the back sloped portion 25 may be parts of the ramp canopy end section 21. The flat portion 23 may extended between half and ⅔ of the total length of a ramp canopy 3 or ramp canopy end section 21. A back sloped angle 27 configured to cause rainwater on the back sloped portion 25 to run back to the gutter 7 instead of off an edge of the ramp canopy. A drain aperture 17 in the upright connector 15 may be configured to drain rainwater out of the gutter 7 and into the upright connector 15.

The wheelchair ramp canopy may further comprise a canopy adaptor 33 attached to the ramp section canopy 3. The canopy adaptor 33 may comprise a gutter 7 that channels water to a drain aperture 17 in an upright connector 15. The canopy upright 9 may have an upright inner support post 37 and an upright cover post 39, wherein the upright inner support post 37 is configured to fit within an upright connector 15, and the upright cover post 39 is configured to fit over the upright inner support post 37. The upright cover post 39 and the upright connector 15 may have the same cross-sectional dimension for a more appealing look. A blade seal 35 on the canopy adaptor 33 may be configured to press against or interface with a landing canopy 29 and prevent rainwater from dripping between the landing canopy 29 and the canopy adaptor 33.

A method of protecting a wheelchair ramp from rain comprising, providing a ramp section canopy 101, gathering rainwater in a gutter 103, channeling the rainwater into a canopy upright 105, and draining the rainwater out of an adjustment channel in an adjustable leg 107. The channeling step may include coupling an upright connector to the gutter 109 and providing a drain aperture 111 in the upright connector to channel rainwater into the canopy upright. Connecting a plurality of ramp sections together 113 comprising, locking a male J-hook connector into a female J-hook connector of an adjacent ramp section canopy. Providing a ramp canopy end section 115 having, a flat portion, and a back sloped portion. Then providing a back sloped angle and running rainwater on the back sloped portion back to the gutter instead of off an end. Then drain rainwater out of the gutter through a drain aperture into the upright connector 119. Providing a canopy adaptor attached to the ramp section canopy, draining rainwater out of a gutter in the canopy adaptor through a drain aperture in an upright connector 121. Fitting an upright inner support post within the upright connector 123 and covering the upright inner support post with an upright cover post. The upright cover post has the same cross-sectional dimension as the upright connector 125. Preventing rainwater from dripping between a landing canopy and the canopy adaptor 127 by pressing a blade seal coupled to the canopy adaptor against the landing canopy.

A full canopy system may have all the major parts shown in FIG. 6. A canopy may comprise a plurality of ramp section canopies 3 each comprising a gutter 7. Also, a plurality of canopy uprights 9 and a plurality of upright connectors 15, wherein the plurality of upright connectors 15 is coupled to the gutters 7. The canopy may have a ramp canopy end section 21 having a back sloped portion 25. Further the canopy may have a canopy adaptor 33 attached to at least one ramp section canopy 3. In many instances the canopy system may include a landing canopy 29.

I claim:

1. A wheelchair ramp canopy comprising,
a ramp section canopy,
a gutter,
a canopy upright, and
an adjustable leg, wherein
the gutter is configured to gather rainwater and the canopy upright is configured to channel rainwater down to an adjustment channel in the adjustable leg and drain out onto a ground surface,
a canopy adaptor attached to the ramp section canopy,
the canopy adaptor comprising,
a gutter, and
a drain aperture in an upright connector configured to drain rainwater into the upright connector,
a blade seal configured to press against a landing canopy and prevent rainwater from dripping between the landing canopy and the canopy adaptor.

2. The wheelchair ramp canopy of claim 1 further comprising,
an upright connector, wherein
the upright connector is coupled to the gutter, and
a drain aperture in the upright connector is configured to allow rainwater to exit the gutter into the upright connector.

3. The wheelchair ramp canopy of claim 1 further comprising,
a male J-hook connector,
the male J-hook connector is configured to fit into and lock inside a female J-hook connector of an adjacent ramp section canopy.

4. The wheelchair ramp canopy of claim 1 further comprising,
a flat portion, and
a back sloped portion, wherein
the flat portion extends to an upright connector and the gutter.

5. The wheelchair ramp canopy of claim 4 further comprising, the flat portion extending ⅔ of a total length of a ramp canopy end section.

6. The wheelchair ramp canopy of claim 4 further comprising, a back sloped angle configured to cause rainwater on the back sloped portion to run back to the gutter.

7. The wheelchair ramp canopy of claim 4 further comprising, a drain aperture in the upright connector configured to drain rainwater out of the gutter and into an upright connector.

8. The wheelchair ramp canopy of claim 1 wherein, the canopy upright comprises, an upright inner support post, and an upright cover post, wherein the upright inner support post is configured to fit within an upright connector, and the upright cover post is configured to fit over the upright inner support post.

9. The wheelchair ramp canopy of claim 8 wherein, the upright cover post is the same dimension as the upright connector wherein, the upright connector and the upright cover post are the same cross-sectional dimension.

10. A method of protecting a wheelchair ramp from rain comprising, providing a ramp section canopy, gathering rainwater in a gutter, channeling the rainwater into a canopy upright, and draining the rainwater out of an adjustment channel in an adjustable leg, preventing rainwater from dripping between a landing canopy and a canopy adaptor by, pressing a blade seal coupled to the canopy adaptor against the landing canopy.

11. The method of claim 10 wherein, channeling rainwater in a gutter includes, coupling an upright connector to the gutter, and providing a drain aperture in the upright connector to channel rainwater into the canopy upright.

12. The method of claim 10 further comprising, connecting a plurality of ramp sections together comprising, locking a male J-hook connector into a female J-hook connector of an adjacent ramp section canopy.

13. The method of claim 10 further comprising, providing a ramp canopy end section having, a flat portion, and a back sloped portion providing a back sloped angle, running rainwater on the back sloped portion back to the gutter instead of off an end, and draining rainwater out of the gutter through a drain aperture into an upright connector.

14. The method of claim 10 further comprising, providing a canopy adaptor attached to the ramp section canopy, draining rainwater out of a gutter in the canopy adaptor through a drain aperture in an upright connector.

15. The method of claim 11 further comprising, fitting an upright inner support post within the upright connector, and covering the upright inner support post with an upright cover post.

16. The method of claim 15 wherein, the upright cover post has the same cross-sectional dimension as the upright connector.

17. A canopy comprising, a plurality of ramp section canopies each comprising a gutter, a plurality of canopy uprights and an upright connector, wherein the upright connector is coupled to the gutter, a ramp canopy end section having a back sloped portion, a canopy adaptor attached to at least one of the ramp section canopies, and a landing canopy.

18. The canopy of claim 17 further comprising, a blade seal configured to press against a landing canopy and prevent rainwater from dripping between the landing canopy and the canopy adaptor.

19. The canopy of claim 17 further comprising, a male J-hook connector, the male J-hook connector is configured to fit into and lock inside a female J-hook connector of an adjacent ramp section canopy.

20. The canopy of claim 17 further wherein, the upright connector is coupled to the gutter, and a drain aperture in the upright connector is configured to allow rainwater to exit the gutter into the upright connector.

* * * * *